US007922867B2

(12) United States Patent
Schall et al.

(10) Patent No.: US 7,922,867 B2
(45) Date of Patent: Apr. 12, 2011

(54) METHOD FOR PRODUCING PAPER, PAPERBOARD AND CARDBOARD HAVING HIGH DRY STRENGTH

(75) Inventors: Norbert Schall, Roemerberg (DE); Ellen Krueger, Otterstadt (DE); Martin Ruebenacker, Altrip (DE)

(73) Assignee: BASF SE, Ludwigshafen (DE)

( * ) Notice: Subject to any disclaimer, the term of this patent is extended or adjusted under 35 U.S.C. 154(b) by 274 days.

(21) Appl. No.: 12/282,358

(22) PCT Filed: Mar. 9, 2007

(86) PCT No.: PCT/EP2007/052238

§ 371 (c)(1),
(2), (4) Date: Sep. 10, 2008

(87) PCT Pub. No.: WO2007/104716

PCT Pub. Date: Sep. 20, 2007

(65) Prior Publication Data

US 2010/0108279 A1 May 6, 2010

(30) Foreign Application Priority Data

Mar. 16, 2006 (EP) ..... 06111267

(51) Int. Cl.
*D21H 21/18* (2006.01)

(52) U.S. Cl. ..... 162/158; 162/163; 162/164.1; 162/164.6; 162/168.1; 162/168.2; 162/183

(58) Field of Classification Search ..... 162/163, 162/164.1, 164.6, 164.7, 166, 168.1, 168.2, 162/168.7, 183

See application file for complete search history.

(56) References Cited

U.S. PATENT DOCUMENTS

| | | | | |
|---|---|---|---|---|
| 2,721,140 | A * | 10/1955 | Weisgerber | 525/333.9 |
| 3,448,005 | A | 6/1969 | Allison, Jr. et al. | |
| 4,880,497 | A * | 11/1989 | Pfohl et al. | 162/135 |
| 5,630,907 | A | 5/1997 | Nilz et al. | |
| 6,228,217 | B1 * | 5/2001 | Dickerson et al. | 162/158 |
| 6,315,824 | B1 * | 11/2001 | Lauzon | 106/287.2 |

FOREIGN PATENT DOCUMENTS

| | | | |
|---|---|---|---|
| CA | 1110019 | | 10/1981 |
| DE | 35 06 832 | A1 | 8/1986 |
| DE | 40 01 808 | A | 7/1991 |
| DE | 195 37 088 | A1 | 4/1997 |
| DE | 10 2004 056 551 | | 5/2006 |
| EP | 0 362 770 | A2 | 4/1990 |
| EP | 0 438 744 | A1 | 7/1991 |
| EP | 0 672 212 | B1 | 6/1996 |
| EP | 0 723 047 | A2 | 7/1996 |
| JP | 11-140787 | | 5/1999 |
| WO | WO 03/052206 | A1 | 6/2003 |
| WO | WO 2004/061235 | A1 | 7/2004 |
| WO | WO 2006/056381 | | 6/2006 |

OTHER PUBLICATIONS

Jürgen Falbe, et al, "Römpp Chemie Lexikon", 9. Erweiterte und neubearbeitete Auflage, Georg Thieme Verlag Stuttgart, 1990, 2 pages.

* cited by examiner

*Primary Examiner* — Eric Hug
*Assistant Examiner* — Peter Chin
(74) *Attorney, Agent, or Firm* — Oblon, Spivak, McClelland, Maier & Neustadt, L.L.P.

(57) ABSTRACT

Process for the production of paper, board and cardboard having high dry strength by separate addition of a polymer comprising vinylamine units and of ligninsulfonic acid and/or a ligninsulfonate to a paper stock, draining of the paper stock and drying of the paper products.

13 Claims, No Drawings

METHOD FOR PRODUCING PAPER, PAPERBOARD AND CARDBOARD HAVING HIGH DRY STRENGTH

The invention relates to a process for the production of paper, board and cardboard having high dry strength by separate addition of a polymer comprising vinylamine units and of a polymeric anionic compound to a paper stock, draining of the paper stock and drying of the paper products.

For the production of paper having high dry strength, it is known that dilute aqueous solutions of boiled starch or of synthetic polymers, which in each case act as a dry strength agent, can be applied to the surface of already dried paper. The amounts of dry strength agent are as a rule from 0.1 to 6% by weight, based on the dry paper. Since the dry strength agents, including the starch, are applied in an aqueous dilute solution—in general, the polymer or starch concentration of the aqueous preparation solution is from 1% to 10% by weight—a considerable amount of water has to be evaporated in the subsequent drying process. The drying step is therefore very energy-consumptive. In many cases, however, the capacity of the customary drying apparatuses on paper machine is not so large that the machine could be operated at the maximum possible production speed. The production speed of the paper machine must instead be decreased so that the paper is adequately dried.

CA Patent 1 110 019 discloses a process for the production of paper having a high dry strength, in which first a water-soluble cationic polymer, e.g. polyethylenimine, is added to the paper stock and then a water-soluble anionic polymer, e.g. of hydrolyzed polyacrylamide is added and the paper stock is drained on the paper machine with sheet formation. The anionic polymers comprise up to 30 mol % of acrylic acid incorporated in the form of polymerized units.

DE-A 35 06 832 discloses a process for the production of paper having high dry strength, in which first water-soluble cationic polymer and then a water-soluble anionic polymer are added to the paper stock. Suitable anionic polymers are, for example, homo- or copolymers of ethylenically unsaturated $C_3$- to $C_5$-carboxylic acids. The copolymers comprise at least 35% by weight of an ethylenically unsaturated $C_3$- to $C_5$-carboxylic acid (e.g. acrylic acid) incorporated in the form of polymerized units. Cationic polymers described in the examples are polyethylenimine, polyvinylamine, polydiallyldimethylammonium chloride and condensates of adipic acid and diethylenetriamine which are crosslinked with epichlorohydrin. Use of partly hydrolyzed homo- and copolymers of N-vinylformamide has also been considered. The degree of hydrolysis of the N-vinylformamide polymers is at least 30 mol % and is preferably from 50 to 100 mol %.

JP-A 1999-140787 relates to a process for the production of corrugated board, from 0.05 to 0.5% by weight, based on dry paper stock, of a polyvinylamine which is obtainable by hydrolysis of polyvinylformamide having a degree of hydrolysis of from 25 to 100%, in combination with an anionic polyacrylamide, being added to the paper stock for improving the strength properties of a paper product, and the paper stock then being drained and dried.

WO 03/052206 discloses a paper product having improved strength properties, which is obtainable by applying a polyvinylamine and a polymeric anionic compound which can form a polyelectrolyte complex with polyvinylamine, or a polymeric compound having aldehyde functions, such as polysaccharides comprising aldehyde groups, to the surface of a paper product. Not only is an improvement of the dry and wet strength of the paper obtained but a sizing effect of the treatment compositions is also observed.

WO 04/061235 discloses a process for the production of paper, in particular tissue, having particularly high wet and/or dry strengths, in which first a water-soluble cationic polymer which comprises at least 1.5 meq of primary amino functionalities per g of polymer and has a molecular weight of at least 10 000 Dalton is added to the paper stock. Partly and completely hydrolyzed homopolymers of N-vinylformamide are particularly singled out here. A water-soluble anionic polymer which comprises anionic and/or aldehydic groups is then added. In particular, the variability of the two-component systems described with regard to various paper properties, including wet and dry strength, is emphasized as an advantage of this process.

EP-A 438 744 discloses the use of copolymers of, for example, N-vinylformamide and acrylic acid, methacrylic acid and/or maleic acid having a K value of from 8 to 50 (determined according to H. Fikentscher in 1% strength aqueous solution at pH 7 and 25° C.) and the polymers obtainable therefrom by partial or complete elimination of formyl groups from the vinylformamide incorporated in the form of polymerized units with formation of vinylamine units for preventing deposits in water-carrying systems, such as vessels or pipes.

It is also known that copolymers which are obtainable by copolymerization of N-vinylcarboxamides, monoethylenically unsaturated carboxylic acids and, if appropriate, other ethylenically unsaturated monomers and subsequent hydrolysis of the vinylcarboxylic acid units present in the copolymers to the corresponding amine or ammonium units can be used in papermaking as an additive to the paper stock for increasing the drainage rate and the retention and the dry and wet strength of the paper, cf. EP-B 672 212.

Prior German Application 10 2004 056 551.1 discloses a process for the production of paper, board and cardboard having a high dry strength by separate addition of a polymer comprising vinylamine units and of a polymeric anionic compound to a paper stock, draining of the paper stock and drying of the paper products. Here, at least one copolymer which is obtainable by copolymerization of (a) at least one N-vinylcarboxamide of the formula

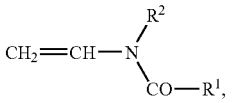

(I)

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule is used as the polymeric anionic compound.

It is also known that ligninsulfonic acid and ligninsulfonates can be used as dispersants in cement mortars and gypsum mortars, as floatation agents, as an additive in feed pelletting, as foundry sand binders and as agglomerating agents in the smelting of ores., cf. Römpp, 9th edition, Georg Thieme Verlag Stuttgart, 1990, page 2511.

It is the object of the present invention to provide a further process for the production of paper having high dry strength and as low wet strength as possible. It is intended for the dry strength, in particular in packaging papers (e.g. corrugated board obtained from waste paper, fluting), to be further improved compared with the processes known to date.

The object is achieved, according to the invention, by a process for the production of paper, board and cardboard having high dry strength by separate addition of a polymer comprising vinylamine units and of a polymeric anionic compound to a paper stock, draining of the paper stock and drying of the paper products, if ligninsulfonic acid and/or a ligninsulfonate is used as the polymeric anionic compound.

In the process according to the invention, a polymer comprising vinylamine units is added as a polymeric cationic component to the paper stock. These compounds are preferably used as the sole cationic component. However, they can, if appropriate, be replaced to a proportion of 50% by weight by other cationic polymers, such as cationic poly(meth)acrylamides, polydiallyldimethylammonium chlorides, condensates of dimethylamine and epichlorohydrin or polydialkyl (meth)acrylamides.

Suitable polymers comprising vinylamine units are all polymers which are mentioned, for example, in WO 04/061235, page 12, line 28 to page 13, line 21, and in FIG. 1, cited in connection with the prior art. The molar mass $M_w$ of the polymers comprising vinylamine units is, for example, from 1000 to 5 million and is at least in the range of from 5000 to 500 000, preferably from 40 000 D to 400 000 D.

Polymers comprising vinylamine units are obtainable, for example, by polymerization of at least one monomer of the formula

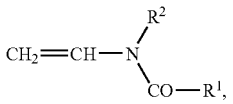

(I)

where $R^1$, $R^2$ are H or $C_1$- to $C_6$-alkyl, and subsequent partial or complete elimination of the —CO—$R^1$ groups from those units of the monomers I which are incorporated in the polymer in the form of polymerized units with formation of amino groups. In the preparation of these polymers, it is known that amidine units can form in the secondary reaction from vinylamine units and neighboring vinylformamide units. For the cationic polymers described here, vinylamine units are stated as the sum of vinylamine and amidine units in the polymer. For example, an N-vinylformamide homopolymer having a degree of hydrolysis of at least 1 mol % is used as polymer comprising vinylamine units. Polyvinylamine and/or N-vinylformamide homopolymers having a degree of hydrolysis of at least 50 mol % are preferably used as the cationic component in the process according to the invention.

In the process according to the invention, amphoteric copolymers which comprise vinylamine units and which have at least 10 mol % more cationic than anionic groups can also be used as cationic component. Such amphoteric polymers are obtainable, for example, by copolymerization of (a) at least one N-vinylcarboxamide of the formula

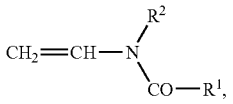

(I)

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule and subsequent partial or complete elimination of the —CO—$R^1$ groups from those units of the monomers I which are incorporated in the polymer in the form of polymerized units with formation of amino groups, the proportion of the amino groups in the copolymer being at least 10 mol % greater than the proportion of the units of monoethylenically unsaturated monomers comprising acid groups.

This group of polymers which are amphoteric and which have altogether more cationic than anionic groups comprises, for example, up to not more than 35 mol %, preferably up to not more than 10 mol % of at least one monomer of group (b) comprising acid groups, incorporated in the form of polymerized units.

According to the invention, ligninsulfonic acid and/or a ligninsulfonate is suitable as the polymeric anionic compound. Further information on these products is to be found, for example, in the abovementioned reference Römpp, 9th edition, G. Thieme Verlag Stuttgart, 1990, page 2511, and in Ullmann's Encyclopedia of Industrial Chemistry, 5th Completely Revised Edition, Volume A15, pages 311 to 314. Ligninsulfonic acid forms in cellulose production by the sulfite digestion of wood, lignin reacting with sulfurous acid. Sulfonation is effected here at the $C_3$ side chains of the phenyl propane units. Depending on the chemicals used in the digestion of the wood, ligninsulfonic acid or ligninsulfonates, for example the sodium, potassium, ammonium, magnesium or calcium salts of ligninsulfonic acid, form. Ligninsulfonic acid and said salts of ligninsulfonic acid are soluble in water. The molar mass of the ligninsulfonic acid is, for example, from 10 000 to 200 000 g/mol. Ligninsulfonates are obtained, for example, from the sulfite waste liquors (black liquor) of cellulose production.

In the process according to the invention, for example, ligninsulfonic acid and/or at least one ligninsulfonate and then at least on polymer comprising vinylamine units are metered in succession into a paper stock. However, it is also possible first to add a polymer comprising vinylamine units and then ligninsulfonic acid and/or a ligninsulfonate to a paper stock and then to drain the latter with sheet formation. All that is important is that cationic polymer and the anionic component be metered separately from one another. Ligninsulfonic acid and/or ligninsulfonate are used, for example, in an amount of from 0.1 to 10% by weight, preferably from 0.2 to 5% by weight and in particular from 0.5 to 2% by weight, based on dry paper stock.

For example, the water-soluble sodium, potassium, ammonium, calcium or magnesium salts or mixtures thereof are used as the ligninsulfonate. The sodium, ammonium and calcium salts are preferably used.

Polymer comprising vinylamine units and ligninsulfonic acid and/or ligninsulfonate are used in the process according to the invention, for example, in the weight ratio of from 5:1 to 1:5, preferably in the weight ratio of from 2:1 to 1:2.

In a preferred embodiment of the process according to the invention, ligninsulfonic acid and/or ligninsulfonate are used together with an anionic copolymer of an N-vinylcarboxamide. The metering of these two components can be effected separately or as a mixture. Preferably, however, first ligninsulfonate and then the anionic polymer are metered, but the sequence of metering of these compounds can also be inverted. Thus, according to the invention, (i) ligninsulfonic acid and/or a ligninsulfonate and (ii) at least one copolymer which is obtainable by copolymerization of (a) at least one N-vinylcarboxamide of the formula

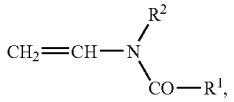

(I)

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule are used, for example, as the polymeric anionic compound.

The polymeric anionic compound preferably used is (ii) a copolymer which is obtainable by copolymerization of (a) N-vinylformamide, (b) acrylic acid, methacrylic acid and/or the alkali metal or ammonium salts thereof and, if appropriate, (c) other monoethylenically unsaturated monomers.

The polymeric anionic compound (II) comprises, for example, (a) from 10 to 95 mol % of units of formula I, (b) from 5 to 90 mol % of units of a monoethylenically unsaturated carboxylic acid having 3 to 8 carbon atoms in the molecule and/or the alkali metal, alkaline earth metal or ammonium salts thereof and (c) from 0 to 30 mol % of units of at least one other monoethylenically unsaturated monomer.

These compounds can be modified in such a way that they additionally comprise at least one compound having at least two ethylenically unsaturated double bonds in the molecule, incorporated in the form of polymerized units. If the monomers (a) and (b) or (a), (b) and (c) are copolymerized in the presence of such a compound, branched copolymers are obtained. The ratios and reaction conditions should be chosen so that polymers which are still water-soluble are obtained. In certain circumstances, it may be necessary to use polymerization regulators for this purpose. All known regulators, such as, for example, thiols, sec-alcohols, sulfites, phosphites, hypophosphites, thio acids, aldehydes, etc. can be used (further information is to be found, for example, in EP-A 438 744, page 5, lines 7-12). The branched copolymers comprise, for example, (a) from 10 to 95 mol % of units of formula I (b) from 5 to 90 mol % of units of a monoethylenically unsaturated monomer comprising acid groups and/or the alkali metal, alkaline earth metal or ammonium salts thereof, (c) from 0 to 30 mol % of units of at least one other monoethylenically unsaturated monomer and (d) from 0 to 2 mol %, preferably from 0.001 to 1 mol %, of at least one compound having at least two ethylenically unsaturated double bonds incorporated in the form of polymerized units.

Examples of monomers of group (a) are N-vinylformamide, N-vinyl-N-methylformamide, N-vinylacetamide, N-vinyl-N-methylacetamide, N-vinyl-N-ethylacetamide, N-vinyl-N-methylpropionamide and N-vinylpropionamide. The monomers of group (a) can be used alone or as a mixture in the copolymerization with the monomers of the other groups.

Monoethylenically unsaturated carboxylic acids having 3 to 8 carbon atoms and the water-soluble salts of these carboxylic acids are particularly suitable as monomers of the group (b). This group of monomers includes, for example, acrylic acid, methacrylic acid, dimethacrylic acid, ethacrylic acid, maleic acid, fumaric acid, itaconic acid, mesaconic acid, citraconic acid, methylenemalonic acid, allylacetic acid, vinylacetic acid and crotonic acid. Other suitable monomers of group (b) are monomers comprising sulfo groups, such as vinylsulfonic acid, acrylamido-2-methylpropanesulfonic acid and styrenesulfonic acid, and vinylphosphonic acid. The monomers of this group can be used alone or as a mixture with one another, in partly or completely neutralized form, in the copolymerization. For example, alkali metal or alkaline earth metal bases, ammonia, amines and/or alkanolamines are used for the neutralization. Examples of these are sodium hydroxide solution, potassium hydroxide solution, sodium carbonate, potassium carbonate, sodium bicarbonate, magnesium oxide, calcium hydroxide, calcium oxide, triethanolamine, ethanolamine, morpholine, diethylenetriamine or tetraethylenepentamine. The monomers of group (b) are used in the copolymerization preferably in partly neutralized form.

For modification, the copolymers can, if appropriate, comprise monomers of group (c) incorporated in the form of polymerized units, for example esters of ethylenically unsaturated $C_3$- to $C_5$-carboxylic acids, such as methyl acrylate, ethyl acrylate, n-butyl acrylate, isobutyl acrylate, isobutyl methacrylate, methyl methacrylate, ethyl methacrylate and vinyl esters, e.g. vinyl acetate or vinyl propionate, or other monomers such as N-vinylpyrrolidone, N-vinylimidazole, acrylamide and/or methacrylamide.

A further modification of the copolymers is possible by using in the copolymerization monomers (d) which comprise at least two double bonds in the molecule, e.g. methylene bisacrylamide, glycol diacrylate, glycol dimethacrylate, glyceryl triacrylate, triallylamine, pentaerythrityl triallyl ether, polyalkylene glycols or polyols at least diesterified with acrylic acid and/or methacrylic acid, such as pentaerythritol, sorbitol or glucose. If at least one monomer of group (d) is used in the copolymerization, the amounts used are up to 2 mol %, e.g. from 0.001 to 1 mol %.

The copolymerization of the monomers is effected in a known manner in the presence of free radical polymerization initiators and, if appropriate, in the presence of polymerization regulators, cf. EP-B 672 212, page 4, lines 13-37 or EP-A 438 744, page 2, line 26 to page 8, line 18.

Amphoteric copolymers which are obtainable by copolymerization of (a) at least one N-vinylcarboxamide of the formula

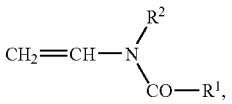

(I)

where $R^1$, $R^2$ are H or to $C_6$-alkyl, (b) at least one monoethylenically unsaturated carboxylic acid having 3 to 8 carbon atoms in the molecule and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule, and subsequent partial elimination of —CO—$R^1$ groups from the monomers of the formula I incorporated in the copolymer in the form of polymerized units with formation of amino groups, the content of amino groups in the copolymer being at least 5 mol % less than the content of those acid groups of the monomers (b) which are incorporated in the form of polymerized units, are also suitable as polymeric anionic compounds (II). In the hydrolysis of N-vinylcarboxamide polymers, amidine units form in a secondary reaction by reaction of vinylamine units with a neighboring vinylformamide unit. Below, vinylamine units in the amphoteric copolymers are always stated as the sum of vinylamine and amidine units.

The amphoteric compounds thus obtainable and having an overall anionic charge comprise, for example, (a) from 10 to 95 mol % of units of the formula I, (b) from 5 to 90 mol % of units of a monoethylenically unsaturated monomer comprising acid groups and/or the alkali metal, alkaline earth metal or ammonium salts thereof, (c) from 0 to 30 mol % of units of at least one other monoethylenically unsaturated monomer, (d) from 0 to 2 mol % of at least one compound which has at least two ethylenically unsaturated double bonds in the molecule and (e) from 0 to 42 mol % of vinylamine units incorporated in the form of polymerized units, the content of amino groups in the copolymer being at least 5 mol % less than the content of monomers (b) comprising acid groups and incorporated in the form of polymerized units.

The hydrolysis of the anionic copolymer can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP-A 438 744, page 8, line 20 to page 10, line 3. The statements made there apply in context to the preparation of the amphoteric polymers to be used according to the invention.

A copolymer which comprises (a) from 50 to 90 mol % of N-vinylformamide, (b) from 10 to 50 mol % of acrylic acid, methacrylic acid and/or the alkali metal or ammonium salts thereof and, if appropriate, (c) from 0 to 30 mol % of at least one other monoethylenically unsaturated monomer incorporated in the form of polymerized units is preferably used as polymeric anionic compound (II).

The average molar masses $M_w$ of the anionic or amphoteric polymers (ii) are, for example, from 30 000 D to 10 million D, preferably from 100 000 D to 1 million D. These polymers have, for example, K values (determined according to H. Fikentscher in 5% strength aqueous sodium chloride solution at pH 7, a polymer concentration of 0.5% by weight and a temperature of 25° C.) in the range of from 20 to 250, preferably from 50 to 150.

The invention also relates to the use of ligninsulfonic acid and/or at least one ligninsulfonate as an additive to the paper stock in the production of paper, board and cardboard in the presence of at least one cationic polymer comprising vinylamine units for increasing the dry strength.

In a preferred embodiment of the invention, first ligninsulfonic acid and/or ligninsulfonate is metered into the paper stock, then the polymer comprising vinylamine units is added and then the paper stock is drained. A particularly preferred embodiment of the process according to the invention is one in which, after addition of ligninsulfonic acid and/or ligninsulfonate and at least one polymer comprising vinylamine units to the paper stock, an anionic copolymer comprising vinylcarboxamide units which is obtainable by copolymerization of (a) at least one N-vinylcarboxamide of the formula

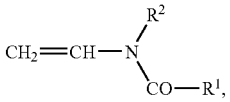

(I)

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, if appropriate, (c) other monoethylenically unsaturated monomers and, if appropriate, (d) compounds which have at least two ethylenically unsaturated double bonds in the molecule, is also added.

The paper stock is then drained.

Suitable fibers for the preparation of the pulps are all those qualities customary for this purpose, e.g. mechanical pulp, bleached and unbleached chemical pulp and paper stocks obtained from all annual plants. Mechanical pulp includes, for example, groundwood, thermomechanical pulp (TMP), chemothermomechanical pulp (CTMP), pressure groundwood, semi-chemical pulp, high-yield pulp and refiner mechanical pulp (RMP). For example, sulfate, sulfite and soda pulps are suitable as chemical pulp. Unbleached chemical pulp, which is also referred to as unbleached kraft pulp, or a paper stock obtained from waste paper is preferably used. Suitable annual plants for the preparation of paper stocks are, for example, rice, wheat, sugar cane and kenaf. The preparation of the pulps is generally effected using waste paper, which is used either alone or as a mixture with other fibers, or fiber mixtures comprising a primary stock and recycled coated broke, for example bleached pine sulfate mixed with recycled coated broke, are used as starting material. The draining of the paper stock is usually effected on a wire of a paper machine. The process according to the invention is particularly important for the production of paper and board from waste paper because it substantially increases the strength properties of the recycled fibers.

The pH of the stock suspension is, for example, in the range of from 4.5 to 8, in general from 6 to 7.5. For example, an acid, such as sulfuric acid, or aluminum sulfate can be used for adjusting the pH.

The polymer comprising vinylamine units, i.e. the cationic component of the polymers to be metered into the paper stock, is added, for example, to the high-consistency stock or preferably to a low-consistency stock in the process according to the invention. The feed point is preferably located before the wires but may also be located between a shear stage and a screen or thereafter. The anionic component, too, is preferably metered into the low-consistency stock.

In a particularly preferred embodiment of the process according to the invention, first ligninsulfonic acid or ligninsulfonate is metered, then, as the sole cationic component, a polymer comprising vinylamine groups and then an anionic polymer of vinylformamide. However, it is also possible first to add the cationic component (polymer comprising vinylamine units as sole cationic component) to the paper stock and to meter the anionic component simultaneously but separately from the cationic component into the paper stock. The polymer comprising vinylamine units is used, for example, in an amount of from 0.05 to 2.0% by weight, preferably from 0.1 to 1% by weight, based on dry paper stock. The ratio of cationic component (polymer comprising vinylamine units) to polymeric anionic component (ligninsulfonic acid and/or ligninsulfonate or combination of ligninsulfonic acid and/or ligninsulfonate with at least one anionic polymer of vinylformamide) is, for example, from 5:1 to 1:5 and is preferably in the range of from 2:1 to 1:2.

Paper products which have a higher dry strength level in combination with low wet strength compared with the processes of the prior art are obtained by the process according to the invention. Compared with known paper products, the papers have in particular a high CMT value.

The parts stated in the following examples are parts by weight, and the percentages are based on the weight of the substances. The K value of the polymers was determined according to H. Fikentscher, Cellulose-Chemie, volume 13, 58-64 and 71-74 (1932) at a temperature of 20° C. in a 5% strength by weight aqueous sodium chloride solution at a pH of 7 and a polymer concentration of 0.5%. In this determination, K=k·1000.

For the individual tests, sheets were produced in a Rapid-Köthen laboratory sheet former in laboratory experiments. The wet breaking length was determined according to DIN 53 112, sheet 2. The determination of the CMT value was effected according to DIN 53 143, and the strip compression resistance (SCT value) was measured according to DIN 54518 and the dry bursting strength according to DIN 53 141.

EXAMPLES

A 4% strength aqueous stock suspension was first prepared from 100% mixed waste paper and was then diluted to a consistency of 0.4%. The pH of the suspension was 7.1 and the freeness of the stock was 40° Schopper-Riegler (° SR). The stock suspension comprised 0.27% of a commercial antifoam (Afranil® SLO). It was then divided into 9 equal parts and processed according to comparative example 1 or according to examples 1 to 8 in the presence of the polymers stated in table 1 on a Rapid-Köthen sheet former to give sheets having a basis weight of from 120 to 130 g/m$^2$. To enable the results to be compared with one another, the individual measured values were converted to apply to sheets having a basis weight of 120 g/m$^2$. The results thus obtained are shown in table 1.

Comparative Example 1

A sheet was formed from the stock suspension described above without further additions.

Examples 1 to 8

The following polymers were used:

A commercial 54.69% strength aqueous solution of the calcium salt of ligninsulfonic acid was used as the ligninsulfonate.

PVAm 1: An N-vinylformamide homopolymer having a degree of hydrolysis of 50% was used in the form of a 13% strength aqueous solution as the cationic polymer. The polymer had a molar mass $M_w$ of 400 000.

Anionic polymer 1: Copolymer of 70% of N-vinylformamide and 30% of sodium acrylate having a molar mass $M_w$ of 400 000.

In examples 1 to 8, the amounts of ligninsulfonate stated in each case in table 1 were first metered into in each case one sample of the paper stock described above, the sample was thoroughly mixed, the cationic polymer (PVAm 1) was then added after a residence time of 20 seconds, the sample was thoroughly mixed again, the anionic polymer 1 was then added after a residence time of 20 seconds, and the paper stock thus obtained was thoroughly mixed and was then drained on a Rapid-Köthen sheet former. The values for the dry bursting strength, the SCT value and the CMT value, converted to apply to sheets having a basis weight of 120 g/m$^2$, are shown in table 1.

TABLE 1

| | Comparative ex. | Example | | | | | | | |
|---|---|---|---|---|---|---|---|---|---|
| | 1 | 1 | 2 | 3 | 4 | 5 | 6 | 7 | 8 |
| Ligninsulfonate [%] | — | 0.5 | 1.0 | 1.5 | 1.0 | 2.0 | 3.0 | 0.5 | 1.0 |
| PVAm 1 [%] | — | 0.5 | 0.5 | 0.5 | 1.0 | 1.0 | 1.0 | 0.5 | 0.5 |
| Anionic polymer [%] | — | — | — | — | — | — | — | 0.5 | 0.5 |
| Dry bursting strength [kPa] | 318.0 | 358.8 | 357.6 | 357.8 | 394.2 | 376.8 | 388.5 | 417.7 | 415.6 |
| Increase [%] | 0 | 13 | 12 | 13 | 24 | 18 | 22 | 31 | 31 |
| SCT value [kN/m] | 1.88 | 2.09 | 2.11 | 2.09 | 2.22 | 2.36 | 2.21 | 2.48 | 2.42 |
| Increase [%] | 0 | 11 | 12 | 11 | 18 | 26 | 17 | 32 | 29 |
| CMT value [N] | 116.5 | 156.83 | 158.6 | 150.24 | 166.8 | 171.6 | 175.2 | 170.3 | 182.2 |
| Increase [%] | 0 | 35 | 36 | 29 | 43 | 47 | 50 | 46 | 56 |

We claim:

1. A process for the production of paper, board or cardboard, having high dry strength, the process comprising separate addition of a cationic polymer comprising vinylamine units, and of a polymeric anionic compound to a paper stock, draining of the paper stock and drying the product thereof, wherein the polymeric anionic compound comprises (i) ligninsulfonic acid and/or a ligninsulfonate and (ii) at least one copolymer which is obtainable by copolymerization of (a) at least one N-vinylcarboxamide of the formula (I)

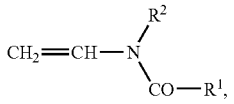

where $R^1$, $R^2$ is H or $C_1$- to $C_6$-alkyl, (b) at least one monoethylenically unsaturated monomer comprising acid groups and/or the alkali metal, alkaline earth metal or ammonium salts thereof and, optionally, (c) at least one other monoethylenically unsaturated monomer, and, optionally, (d) at least one compound which has at least two ethylenically unsaturated double bonds in the molecule.

2. The process according to claim 1, wherein the cationic polymer comprising vinylamine units comprises the at least one compound which is obtainable by polymerization of at least one monomer of the formula (I)

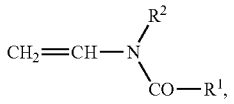

where $R^1$, $R^2$ are H or $C_1$- to $C_6$-alkyl, and subsequent partial or complete elimination of the —CO—$R^1$ groups from those units of the monomers I which are incorporated as polymerized units in the polymer with formation of amino groups.

3. The process according to claim 1, wherein the cationic polymer comprising vinylamine units comprises an N-vinylformamide homopolymer having a degree of hydrolysis of at least 1 mol %.

4. The process according to claim 1, wherein the cationic polymer comprising vinylamine units comprises a copolymer which is obtainable by copolymerization of (a) the at least one N-vinylcarboxamide of the formula (I)

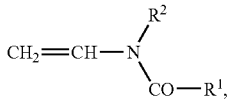

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, optionally, (c) at least one other monoethylenically unsaturated monomers and, optionally, (d) at least one compound which has at least two ethylenically unsaturated double bonds in the molecule and subsequent partial or complete elimination of the —CO—$R^1$ groups from those units of the monomers I which are incorporated in the polymer in the form of polymerized units with formation of amino groups, the proportion of the amino groups in the copolymer being at least 10 mol % greater than the proportion of the units of monoethylenically unsaturated monomers comprising acid groups.

5. The process according to claim 1, wherein the cationic polymer comprising vinylamine units comprises polyvinylamine and/or an N-vinylformamide homopolymer having a degree of hydrolysis of at least 50 mol %.

6. The process according to claim 1, wherein the ligninsulfonate is present and in the form of a water-soluble sodium, potassium, ammonium, calcium or magnesium salt or mixture thereof.

7. The process according to claim 1, wherein the cationic polymer comprising vinylamine units is present in an amount of from 0.05 to 2.0% by weight, based on dry paper stock.

8. The process according to claim 1, wherein the cationic polymer comprising vinylamine units and the polymeric anionic compound are present in a weight ratio of from 5:1 to 1:5.

9. The process according to claim 1, wherein the cationic polymer comprising vinylamine units and the polymeric anionic compound are present in a weight ratio of from 2:1 to 1:2.

10. The process according to claim 1, wherein first the polymeric anionic compound is metered into the paper stock, then the cationic polymer comprising vinylamine units is added and then the paper stock is drained.

11. The process according to claim 1, wherein first the cationic polymer comprising vinylamine units is metered into the paper stock, then the polymeric anionic compound is added and then the paper stock is drained.

12. The process according to claim 1, wherein, after addition of the ligninsulfonic acid and/or ligninsulfonate and the cationic polymer comprising vinylamine units to the paper stock, the at least one copolymer which is obtainable by copolymerization of (a) at least one N-vinylcarboxamide of the formula (I)

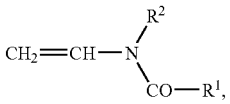

where $R^1$, $R^2$ are H or $C_1$- to $C_6$-alkyl, (b) at least one monoethylenically unsaturated monomer comprising acid groups and/or the alkali metal, alkaline earth metal or ammonium salts thereof and, optionally, (c) at least one other monoethylenically unsaturated monomers and, optionally, (d) at least one compound which has at least two ethylenically unsaturated double bonds in the molecule is also added.

13. A method for increasing the dry strength of paper, board or cardboard, comprising adding (i) ligninsulfonic acid and/or at least one ligninsulfonate and (ii) at least one copolymer which is obtainable by copolymerization of (a) at least one N-vinylcarboxamide of the formula

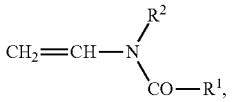

(I)

where $R^1$, $R^2$ is H or $C_1$- to $C_6$-alkyl, (b) at least one monoethylenically unsaturated monomer comprising acid groups and/or the alkali metal, alkaline earth metal or ammonium salts thereof and, optionally, (c) at least one other monoethylenically unsaturated monomer, and, optionally, (d) at least one compound which has at least two ethylenically unsaturated double bonds in the molecule, as an additive to paper stock in the production of said paper, board or cardboard in the presence of at least one cationic polymer comprising vinylamine units.

* * * * *